US007604513B2

(12) United States Patent
Wang et al.

(10) Patent No.: US 7,604,513 B2
(45) Date of Patent: Oct. 20, 2009

(54) POWER CONNECTOR WITH GROUNDING ELEMENT

(75) Inventors: Li-Bin Wang, Kunshan (CN); Wei-Ya Cheng, Kunshan (CN); Su-Feng Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/001,554

(22) Filed: Dec. 11, 2007

(65) Prior Publication Data

US 2008/0139043 A1 Jun. 12, 2008

(30) Foreign Application Priority Data

Dec. 11, 2006 (CN) ..... 2006 2 0165460 U

(51) Int. Cl.
*H01R 24/04* (2006.01)

(52) U.S. Cl. ..... 439/668; 439/669

(58) Field of Classification Search ..... 439/668, 439/669

See application file for complete search history.

(56) References Cited

U.S. PATENT DOCUMENTS

| | | | | |
|---|---|---|---|---|
| 7,134,890 | B2 | 11/2006 | Wang | |
| 7,186,141 | B2 | 3/2007 | Li et al. | |
| 2006/0234562 | A1 * | 10/2006 | Lin | 439/668 |
| 2006/0258212 | A1 | 11/2006 | Li et al. | |

* cited by examiner

*Primary Examiner*—Tho D. Ta
*Assistant Examiner*—Travis Chambers
(74) *Attorney, Agent, or Firm*—Wei Te Chung

(57) ABSTRACT

A power connector includes an insulative housing defining at least one passage, at least a first contact to form anode of the power connector and a second contact to form cathode of the power connector received in the insulative housing and each contact having a contacting portion, and a biasing member received in the one passage of the insulative housing; wherein the biasing member includes a flat positioning portion, and a bent elastic arm respectively elastically bracing against the upper wall and the lower wall of said passage, and a tongue portion having a contacting portion and a grounding element to electrically connect outer electric element, and the contacting portion of the tongue portion is closer to the front surface of the power connector than the contacting portion of at least one of the first and second contacts.

16 Claims, 7 Drawing Sheets

POWER CONNECTOR WITH GROUNDING ELEMENT

BACKGROUND OF THE INVENTION

1. Field of the Invention

The present invention relates to an electrical connector, and more particularly to a power connector.

2. Description of Related Art

Power jacks/plugs are widely used in the electrical industry to connect power supplies with electrical devices, such as mobile phone, note book. The power jack commonly is secured to a circuit board and comprises a dielectric housing, an inner contact and an outer contact respectively served as a positive pole and a negative pole of a power supply for providing voltage to electrical device connecting to the power connector, and a signal contact provided for signal transmission. U.S. Pat. No. 7,186,141 discloses an improved power connector with fastening member. However, the power connector is disturbed by Electro-Static Discharge (ESD) when the power connects a complementary connector. Hence, an improved power connector is desired to overcome the disadvantages of the related art.

SUMMARY OF THE INVENTION

Accordingly, an object of the present invention is to provide a power connector having a grounding element for Electro-Static Discharge.

In order to achieve the object set forth, a power connector comprises an insulative housing defining at least one passage, at least a first contact to form anode of the power connector and a second contact to form cathode of the power connector received in the insulative housing and each contact having a contacting portion, and a biasing member received in the one passage of the insulative housing; wherein the biasing member comprises a flat positioning portion, a bent elastic arm respectively elastically bracing against the upper wall and the lower wall of said passage, and a tongue portion having a contacting portion and a grounding element to electrically connect outer electric element, and the contacting portion of the tongue portion is closer to the front surface of the power connector than the contacting portion of at least one of the first and second contacts.

Other objects, advantages and novel features of the invention will become more apparent from the following detailed description when taken in conjunction with the accompanying drawings.

DETAILED DESCRIPTION OF THE INVENTION

Figure 1:
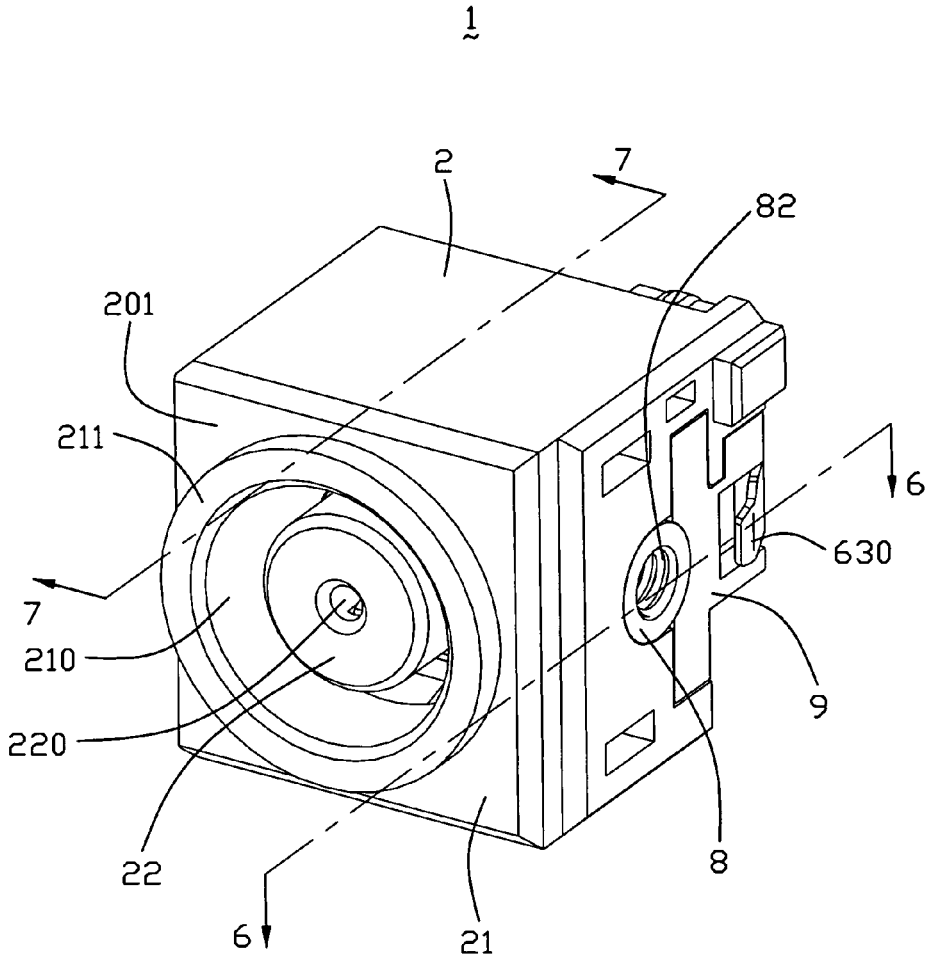
FIG. 1 is an assembled, perspective view of a power connector in accordance with the preferred embodiment of the present invention.

Reference will now be made in detail to the preferred embodiment of the present invention.

Referring to FIGS. 1-4, a power connector 1 in accordance with the first preferred embodiment of the present invention is assembled in an electrical device and comprises an insulative housing 2, a pair of first and second contacts 3, 4 adapted for power transmission, a third contact 5 used for signal transmission, a biasing member 6, a fastening member 8 and a baffle member 9 cooperating with the fastening member 8. The first contact 3 is the anode of the power connector and the second contact 4 is the cathode of the power connector. In the preferred embodiment, the power connector 1 further comprises a cable (not shown) having a plurality of conductors (not shown) respectively solderable to the first, second and third contacts 3, 4, 5.

The insulative housing 2 approximately in the shape of a cubical block defines a front face 201 and a pair of side surfaces 212 perpendicular to the front face 201. The housing 2 is formed with a first housing portion 21 defining a center receiving cavity 210 and a cylindrical second housing portion 22 protruding into the receiving cavity 210 of the first housing portion 21. The second housing portion 22 has a front face (not labeled) flush with the front face 201 and defines a fine receiving groove 220 along a longitudinal axis thereof. A round rim 211 is formed on the front face 201 of the insulative housing 2 along a front fringe of the receiving cavity 210. The insulative housing 2 defines a first passage 213, a second passage 214 and a third passage 215 in a rear-to-front direction respectively corresponding to the first, second and third contacts 3, 4, 5 therein. Specifically, the third passage 215 locates in the center of the housing 2 in communication with the receiving groove 220 and extending in a vertical direction, the first passage 213 is present in a n-shape circling around the third passage 215, and the second passage 214 locates at a lower portion of the first housing portion 21 in communication with the receiving cavity 210. The housing 2 further defines a fourth passage 216 above the first passage 213 for receiving the biasing member 6 therein and a receiving space 217 recessed inwardly from one of the side faces 212. The receiving space 217 defines a pair of channels 2170 recessed downwardly along inner side surfaces thereof, a semicircular first engaging opening 2171 at a front portion thereof and a pair of rectangular cutouts 2172 adjacent to the first engaging opening 2171. A pair of first locating holes 2173 is respectively defined in bottom surfaces of the cutouts 2172. A second locating hole 2174 is recessed inwardly from a rear bottom surface of the receiving space 217.

Figure 3:
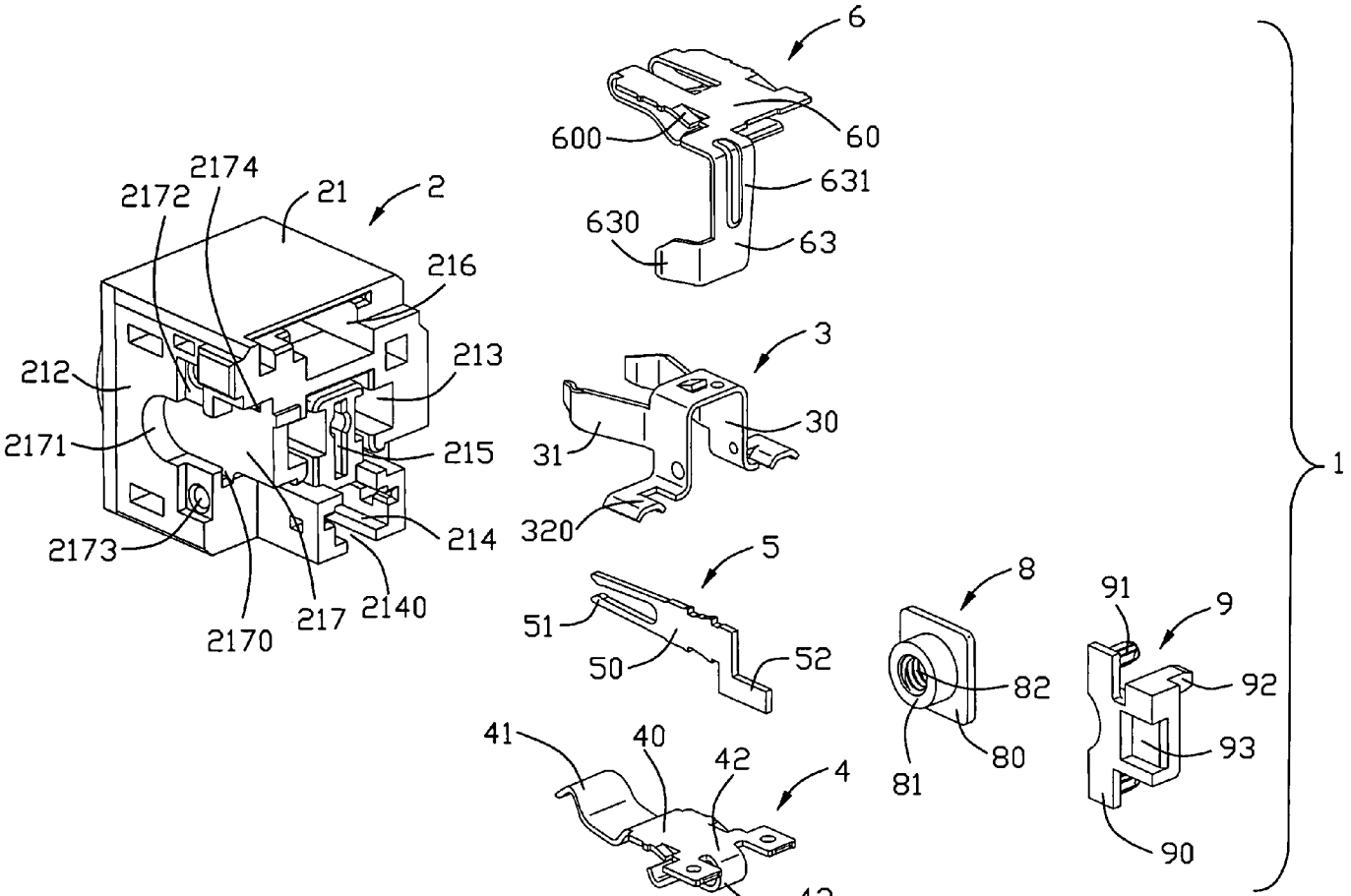
FIG. 3 is an exploded, perspective view of the power connector shown in FIG. 2.
Figure 4:
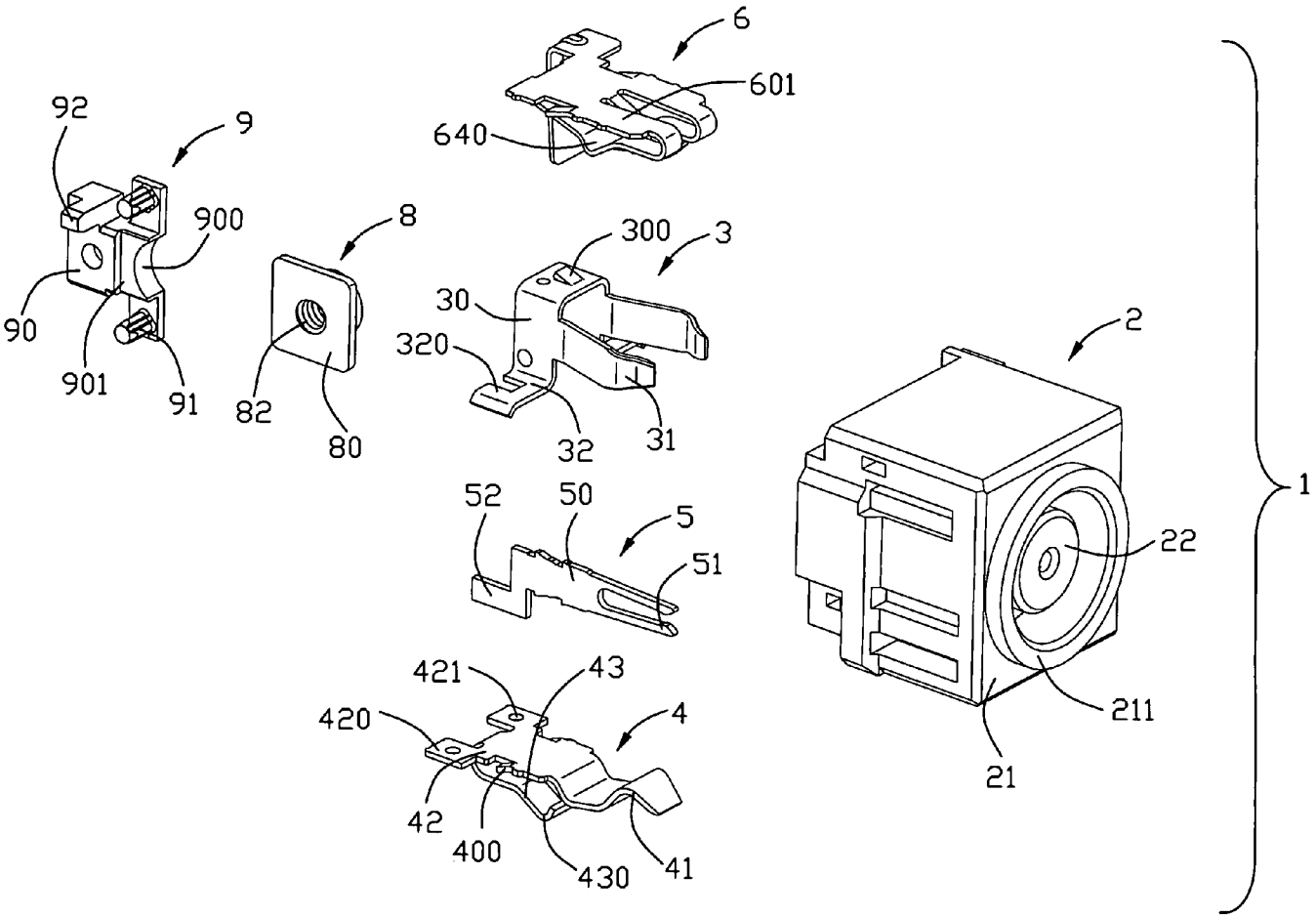
FIG. 4 is a view similar to FIG. 3, but viewed from another aspect.

Referring to FIGS. 3-4, the first contact 3 is inserted into the first passage 213 from a rear side of the housing 2 to serve as a positive pole of the power supply. The first contact 3 is formed with an n-shaped main portion 30, a pair of elastic contacting portions 31 laterally and forward extending from the main portion 30 and a pair of opposite tail portions 32 laterally extending from opposite bottom ends of the main portion 30. The main portion 30 of the first contact 3 forms an upwardly protruding tab 300 thereon for positioning purpose. Each of the tail portions 32 defines a retuse U-shaped connecting portion 320 at free end thereof. The second contact 4 is received in the second passage 214 to serve as a negative pole of the power supply. The second contact 4 comprises a retaining portion 40, a curved elastic contacting portion 41 forward extending from the retaining portion 40, a rearwardly extending tail portion 42 and a forward extending elastic portion 43 extending from the end of the tail portion 42 to locate below the retaining portion 40. The retaining portion 40 forms a pair of latching tabs 400 at opposite sides thereof for elastically received in the second passage 214. The tail portion 42 is formed with two connecting portions 420 spaced apart from each other, each connecting portion 420 defines a through hole 421 in the center thereof for solder material overflowing. The elastic portion 43 forward extends from the tail portion 42 to form a V-shape end 430 electrically connecting other elements.

In the present invention, the first and the second contacts 3, 4 each comprises more than one, in the preferred embodiment a pair of, separate connecting portions 320, 420 to respectively solder with corresponding conductors of the cable for transmitting the same type signal, thus, once one of the electrical connection between the connecting portions 320, 420 and the conductors is broken or unsteady, the power supply will not be impacted due to the unspoiled electrical connection between rest connecting portions 320, 420 and the conductors. Therefore, the reliability of the power connector 1 is noticeably increased and thus ensures the running of the electrical device, to which the power connector 1 is connected. It is also acceptable that each tail portion 32, 42 define two spaced connecting areas solderable with the conductors but not separate soldering portion 320, 420 as depicted above. Also can be acceptable is that the connecting portions 320, 420 connect with the conductors of the cable with other means, such as crimping, IDC etc.

The third contact 5 is received in the third passage 215 on a vertical plane and comprises a fork-shape mating portion 51 exposed to the receiving groove 220, a securing portion 50 rearwardly extending from the mating portion 51 and a connecting portion 52 downwards and rearward extending from the securing portion 50. The securing portion 50 forms a plurality of barbs (not labeled) at opposite sides thereof interferencely engaging with inner side surface of the third passage 215, thereby securely retaining the third contact 5 in the housing 2.

Figure 2:
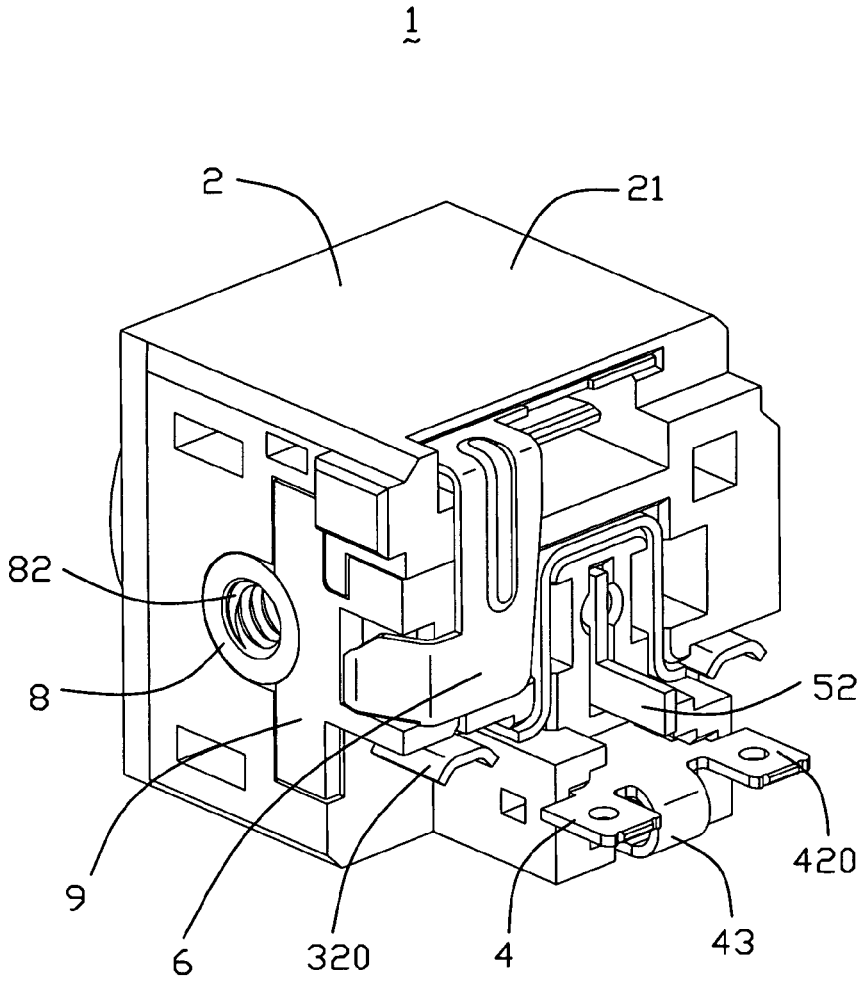
FIG. 2 is a view similar to FIG. 1, but viewed from another aspect.
Figure 5:
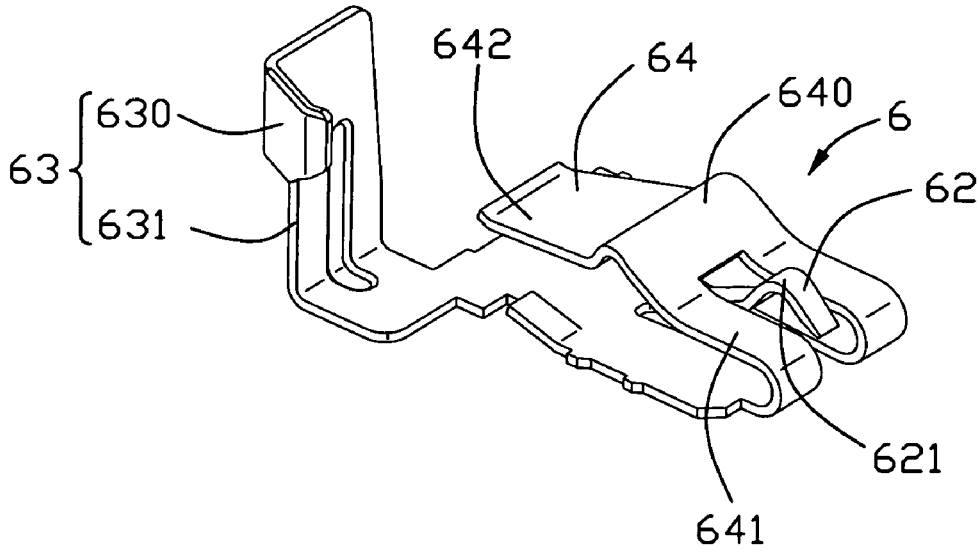
FIG. 5 is a perspective view of a biasing member of the power connector of FIG. 3.
Figure 6:
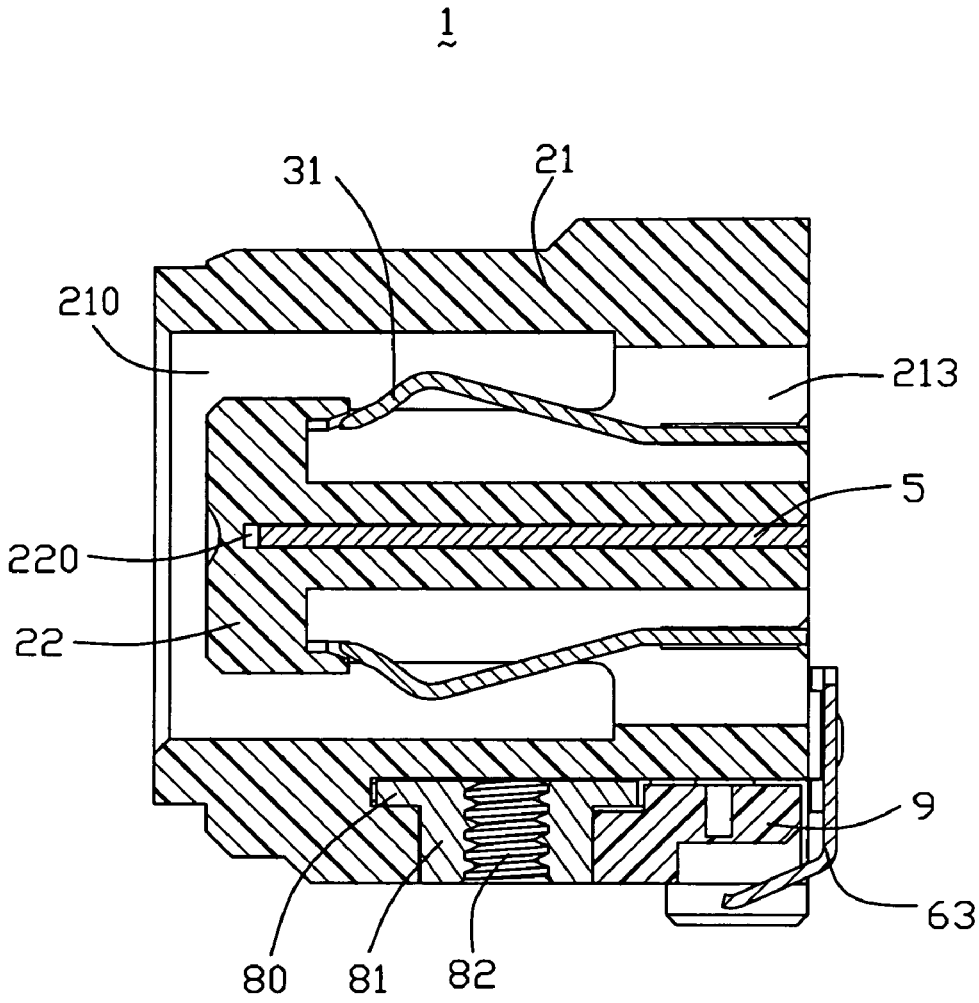
FIGS. 6-7 are cross-sectional views of FIG. 1 taken along lines 6-6 and 7-7.
Figure 7:
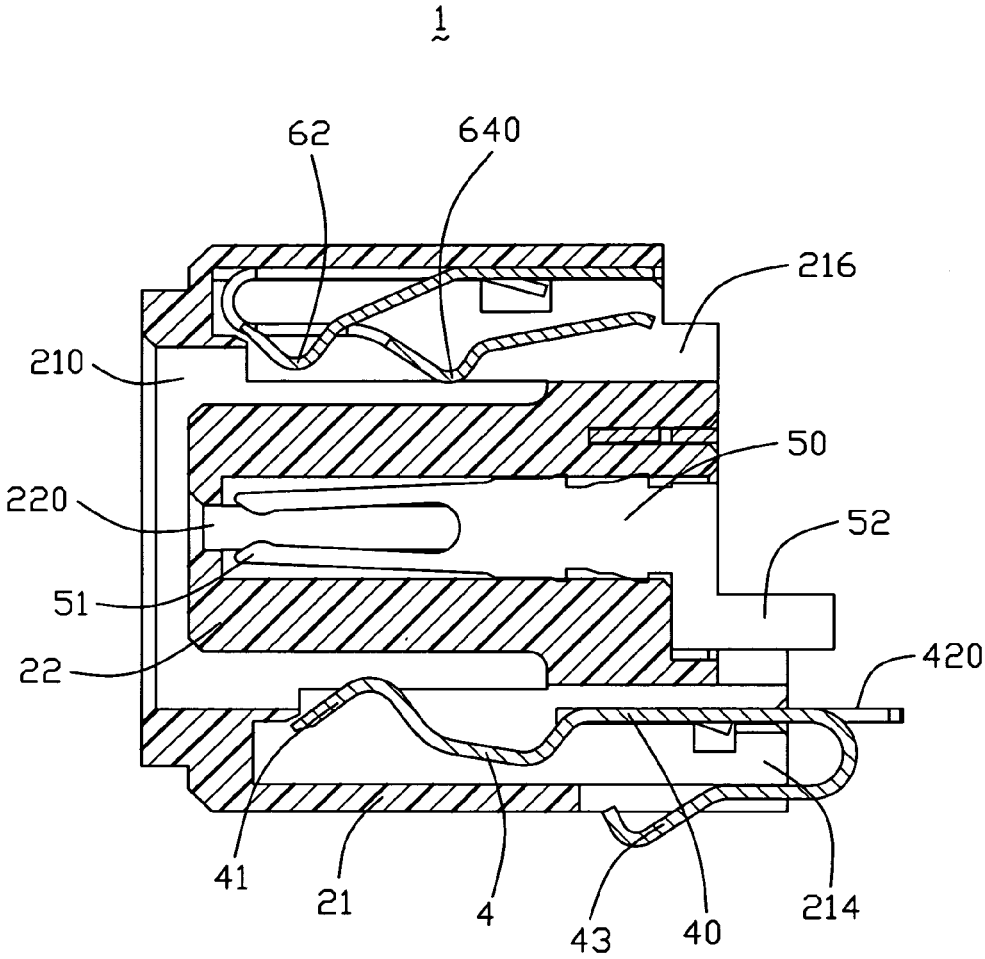

Referring to FIGS. 3-5, the biasing member 6 comprises a flat positioning portion 60 located in a horizontally plane, a bent elastic arm 64 and a tongue portion 62 extending from the same end of the positioning portion 60, and a grounding element 63 rearward and downwards extending from the other end of the positioning portion 60. The grounding element 63 rearward and downwards extends along the rear surface of the insulative housing 2 and comprises an L-shape main body 631 and a tail portion 630. The tail portion 630 exposes out of the insulative housing 2 and defines an end to contact the electric board (not shown) in the electrical device for discharging the electro-static. The bent elastic arm 64 comprises a pair of U-shape branch portions 641 forward extending from the positioning portion 60, a flat tail portion 642 rearward extending from the branch portion 641 and approximate parallel to the positioning portion 60, and an adown sunk arc portion 640 connecting the two U-shape branch portions 641 and the tail portion 642. The branch portion 641 respectively elastically abut against the upper wall and the lower wall of the passage 216. The arc portion 640 is the lowest portion of the bent elastic arm 64. The tongue portion 62 is between the pair of U-shape branch portions 641 and forward and downwards extends from middle of a front edge of the positioning portion 60. A V-shape end 621 is curved at free end of the tongue portion 62. Most of the V-shape end 621 is below the branch portions 641 and in front of the arc portion 640 of the bent elastic arm 64. Reference to FIG. 2, the positioning portion 60 is completely received in the forth passage 216 of the housing 2, and the elastic arm 64 partially protrudes into the receiving cavity 210 to elastically contact with corresponding portion of the complementary connector so as to increase mating/unmating force exerted to the power connector 1, when the power connector 1 is mated with or withdrawn from the complementary connector. Thus, the tongue portion 62 completely protrudes into the receiving cavity 210 and the V-shape end 621 is in front of the arc portion 640 of the bent elastic arm 64. Thus, when the power connector 1 is mated with the complementary connector, the contacting portion of the complementary connector connects the V-shape end 621 of the tongue portion 62 firstly and the arc portion 640 of the elastic 64 secondly.

The fastening member 8 in the preferred embodiment comprises a square base plate 80 located in a vertical plane and a post 81 sideward protruding from the base plate 80. A screw hole 82 is defined in the center of the fastening member 8 through the base plate 80 and the post 81. The fastening member 8 snaps into the receiving space 217 along the pair of channels 2170 in the rear-to-front direction until the post 81 in contact with the first engaging opening 2171.

The baffle member 9 is made of insulative material, and comprises a main board 90 defining a semicircular second engaging opening 900 recessed rearwardly from a front surface thereof, a pair of first protrusions 91 extending sideward from the main board 90 and locating at opposite upper and lower sides of the second engaging opening 900, a second protrusion 92 protruding sideward from a rear-top edge of the main board 90 and a notch 93 connecting the outer side and rear side of the main board 90. Each of the first protrusions 91 has a cylindrical peripheral surface with a plurality of ribs thereon (not labeled). The main board 90 forms a step portion 901 behind the second engaging opening 900. The baffle member 9 is assembled to the housing 2 to securely retain the fastening member 8 to the housing 2. The main board 90 covers on the base plate 80 of the fastening member 8 to fill up the receiving space 217, therefore, the first engaging opening 2171 and the second engaging opening 900 together forms a receiving recess for receiving the post 81 of the fastening member 8 therein. The first and second protrusions 91, 92 are respectively received in the corresponding first and second locating holes 2173, 2174 so as to secure the baffle member 9 to the housing 2. In this way, the baffle member 9 limits the movement of the fastening member 8 relative to the housing 2 in all of the directions. Reference to FIG. 2, the positioning portion 60, the bent elastic arm 64 of the biasing member 6 is received in the fourth passage 216 of the first housing portion 21, and the grounding element 63 is deposed out the first housing portion 21. The L-shape main body 631 downwards extends along the rear surface of the first housing portion 21, and the tail portion 630 extends from the main body 631 behind the rear surface of the first housing portion 21 to the notch 93 of the baffle member 9. Most of the tail portion 630 is received in the notch 93, and the end of the tail portion 630 outward extends out the notch 93. The end of the tail portion 630 is used to contact the electric board (not shown) in the electrical device for Electro-Static Discharging.

In application, the power connector 1 is able to be assembled to a panel of the electrical device via engagement of the fastening member 8 and a screw (not shown). That is, the power connector 1 is secured to the panel in a direction perpendicular to the mating direction thereof. In addition, the fastening member 8 is received in the first housing portion 21 with outer surface thereof flush with one side surface 212 of the first housing portion 21. The fastening member 8 also could be configured in other shapes and assembled to the panel by other ways.

In assembly, the power connector 1 is assembled in the electrical device and the complementary connector connects the power connector 1. For all of the first, second, third contacts 3, 4, 5, the tongue portion 62 and the elastic arm 64 contact the contacts of the complementary connector, each of the five components forms a contacting portion to contact the complementary connector. When the power connector 1 is assembled in the electrical device, the tail portion 630 of the grounding element 63 connects a metal board of the electrical device. The contacts of the complementary connector protrude into the housing 2 of the power connector 1 and the contact which connects the biasing member 6 connects the V-shape end 621 of the tongue portion 62 of the biasing member 6 firstly and connects the arc portion 640 of the elastic arm 64 secondly. Thus, the contacting portion of the tongue portion 62 is in front of the contacting portion of the elastic arm 64. Furthermore, the contacting portion of the tongue portion 62 is defined on a position which is in front of the contacting portion of the first and second contacts 3, 4. Thus, the contacts of the complementary connector electrically connect the metal board of the electrical device through the tongue portion 62 and the grounding element 63 earlier than the first and second contacts 3, 4. The Electro-Static is discharged through the passageway provided by the tongue portion 62. Thus, the tongue portion 62 provides a passageway for Electro-Static Discharging before the first, second contacts 3, 4 communicating signals to contacts of the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector, comprising:

an insulative housing defining at least one passage;

at least a first contact to form anode of the power connector and a second contact to form cathode of the power connector received in the insulative housing and each contact having a contacting portion; and a biasing member received in the one passage of the insulative housing and comprising a flat positioning portion, a bent elastic arm respectively elastically bracing against the upper wall and the lower wall of said passage, and a tongue portion having a contacting portion and a grounding element to electrically connect outer electric element;

wherein the contacting portion of the tongue portion is closer to the front surface of the power connector than the contacting portion of at least one of the first and second contacts; wherein the bent elastic arm comprises a pair of U-shape branch portions extending from the positioning portion, a tail portion approximate parallel to the positioning portion and an adown sunk arc portion connecting the two U-shape branch portions and the tail portion.

2. The power connector as claimed in claim 1, wherein the contacting portion of the tongue portion is closer to the front surface of the power connector than the contacting portions of the first and second contacts.

3. The power connector as claim in claim 1, wherein the tongue portion is between the two U-shape branch portions.

4. The power connector as claimed in claim 1, wherein the contacting portion of the branch portion is behind of the contacting portion of the first and second contacts.

5. The power connector as claimed in claim 1, further comprises a third contact to communicate signals.

6. The power connector as claimed in claim 1, wherein the arc portion is the lowest part of the bent elastic arm.

7. The power connector as claimed in claim 6, wherein the tongue portion comprises a V-shape end whose top forms the contacting portion, and most of the top of the V-shape end is below the branch portions and in front from the arc portion of the U-shape branch portions.

8. The power connector as claimed in claim 1, wherein the insulative housing comprises a receiving space in one of the side surfaces of the housing.

9. The power connector as claimed in claim 8, further comprising a fastening member received in the receiving space of the housing, and the outer surface of the fastening member flush with said one of the side surfaces of the housing.

10. The power connector as claimed in claim 9, further comprising a baffle member made of insulative material and received in the receiving space of the housing to position the fastening member.

11. The power connector as claimed in claim 10, wherein the baffle member has a semicircular second engaging opening to form a columnar space with the receiving space of the housing to enclose the fastening member.

12. The power connector as claimed in claim 10, wherein the baffle member comprises a notch to receive most of the tail portion of the grounding element.

13. An electrical connector comprising:

an insulative housing defining a tubular receiving cavity;

a fastening member formed on one face of the housing;

a biasing member secured to the housing and including a tail section located on said face, and a contacting section extending into said tubular receiving cavity around a top face of the housing; and a contact retained to the housing and including a contacting region extending into the tubular receiving cavity and a mounting region deflectably extending beyond a bottom face of the housing; wherein said biasing member includes a flat positioning portion, a bent elastic arm and a tongue portion; wherein the bent elastic arm and the tongue portion extend from a same end of the positioning portion; wherein the elastic arm comprises a pair of U-shaped branch portions extending from the positioning portion; wherein the tongue portion is located between the pair of U-shaped branch portions.

14. A power connector, comprising:

an insulative housing defining at least one passage;

at least a first contact to form anode of the power connector and a second contact to form cathode of the power connector received in the insulative housing and each contact having a contacting portion; and a biasing member received in the one passage of the insulative housing and comprising a flat positioning portion, a bent elastic arm respectively elastically bracing against the upper wall and the lower wall of said passage, and a tongue portion having a contacting portion and a grounding element to electrically connect outer electric element;

wherein the contacting portion of the tongue portion is closer to the front surface of the power connector than the contacting portion of at least one of the first and second contacts;

wherein the bent elastic arm and the tongue portion extend from a same end of the positioning portion;

wherein the grounding element rearward and downwards extends along the rear surface of the insulative housing and comprises an L-shape main body and a tail portion.

15. The power connector as claimed in claim 14, wherein the bent elastic arm forward and rearward extends from the positioning portion.

16. The power connector as claimed in claim 14, wherein the tongue portion forward and downwards extends from the positioning portion.

* * * * *